US005797150A

United States Patent [19]

Lanz

[11] Patent Number: 5,797,150

[45] Date of Patent: Aug. 25, 1998

[54] SEAMLESS STAINLESS STEEL SINK BOWL WITH A GRID LEDGE

[75] Inventor: Melchior Lanz, Sumiswald, Switzerland

[73] Assignee: Franke Inc., North Wales, Pa.

[21] Appl. No.: 784,661

[22] Filed: Jan. 21, 1997

Related U.S. Application Data

[62] Division of Ser. No. 635,850, Apr. 22, 1996, Pat. No. 5,644,943.

[51] Int. Cl.[6] ..... A47K 1/04

[52] U.S. Cl. ..... 4/619

[58] Field of Search ..... 4/619, 622, 631

[56] References Cited

U.S. PATENT DOCUMENTS

| | | | |
|---|---|---|---|
| 756,239 | 4/1904 | Kelly | 4/619 |
| 2,305,866 | 12/1942 | Graf . | |
| 2,520,486 | 8/1950 | Zeigler et al. . | |
| 2,843,071 | 7/1958 | Kitzinger . | |
| 2,944,500 | 7/1960 | Raynes . | |
| 3,421,466 | 1/1969 | Hess . | |
| 3,564,895 | 2/1971 | Pfanner et al. . | |
| 3,664,172 | 5/1972 | Cvacho . | |
| 3,774,561 | 11/1973 | Herbold . | |
| 3,918,377 | 11/1975 | Herbold | 4/619 X |
| 4,057,022 | 11/1977 | Koshino et al. . | |
| 4,185,488 | 1/1980 | Miller et al. . | |
| 4,309,888 | 1/1982 | Miller et al. . | |

FOREIGN PATENT DOCUMENTS

| | | | |
|---|---|---|---|
| 0634550 | 2/1962 | Italy | 4/619 |
| 6098812 | 4/1994 | Japan | 4/631 |

OTHER PUBLICATIONS

Franke 1193 Catalog, pp. 10, 12 and cover (front and back) showing cast sink bowls with ledge.

*Primary Examiner*—Charles E. Phillips

*Attorney, Agent, or Firm*—Panitch Schwarze Jacobs & Nadel, P.C.

[57] ABSTRACT

A method for forming a stainless steel sink bowl having a top edge, a sidewall and a bottom surface interconnected by smooth corner surfaces from a single sheet is provided. The method comprises drawing a stainless steel blank between a first draw die and a first forming die to form a first drawn blank having an unfinished bowl with a length, width and depth which are less than the finished length and width and generating a deformation warmth in the blank at the corner surfaces in proximity to the rim as the first drawn blank is being formed to a temperature of approximately 70° C. to 90° C. The first drawn blank is immediately removed from the first draw die and the first forming die and transferred to a finish draw die. The first drawn blank is finish drawn, prior to loss of the deformation warmth, between the finish draw die and a finish forming die to form a finish drawn blank having a finished bowl while simultaneously forming a grid ledge at a medial position in a portion of the sidewall of the finished bowl. A stainless steel sink bowl formed from a single sheet of material and having a grid ledge is also provided.

2 Claims, 4 Drawing Sheets

SEAMLESS STAINLESS STEEL SINK BOWL WITH A GRID LEDGE

This is a division of application Ser. No. 08/635,850, filed Apr. 22, 1996 now U.S. Pat. No. 5,644,943.

FIELD OF THE INVENTION

The present invention relates to a method for forming a stainless steel sink bowl, and more particularly, to a method of deep drawing a seamless stainless steel sink bowl with a grid ledge located at a medial portion of the sidewall.

BACKGROUND OF THE INVENTION

Sink bowls made from stainless steel provide excellent durability in comparison to some other materials. Stainless steel sinks are often used in harsh environments to resist damage and in sterile environments. Stainless steel sink bowls are also commonly used for aesthetic reasons to compliment certain kitchen designs.

Methods for deep drawing a seamless sink bowl from one-piece of stainless steel sheet, as well as such sink bowls, are generally known in the art. Stainless steel sink bowls formed by deep drawing have heretofore been limited to smooth sidewalls based on the deep drawing process required to form the bowl. Methods are also known for producing two adjacent sink bowls in a single seamless stainless steel sheet. Generally, such methods for forming single or double bowl sinks involve clamping a stainless steel blank in a double action press. The blank is clamped between upper and lower gripping members, and the bowl is formed in one or more draws by applying a force to a forming die which contacts the clamped blank and forces it through a drawing die. For single deep drawn sink bowls, more than one draw is often required, and partially formed bowls are often stock-piled between the first and subsequent forming steps. Double bowl sinks require a number of drawing steps and the partially formed blanks are also stock-piled between forming steps.

Sink bowls made from cast ceramic, iron, polymeric or other materials are also known in the art. Such sink bowls are generally molded from various materials in liquid form and cured or fired to form the finished sink bowl. A greater variety of shapes and sizes of sink bowls can be made by this method in comparison with forming stainless steel. One such sink bowl, which is manufactured by the assignee of the present application, includes a ledge located at a medial portion of the sidewall of the sink bowl. While this ledge, which is generally used for supporting a wire rack or grid above the bottom of the sink, is easily formed in cast sink bowls, forming such a ledge at a medial portion of a seamless stainless steel sink bowl drawn from a single blank was not thought to be possible. This is due to a number of factors, such as the location of the ledge at a medial position on the sidewall, the depth of draw required, formation of the ledge in less than all sides of the bowl, and the tangential displacement of the sidewall required in forming the ledge which generally leads to wrinkles or puckers resulting in non-usable product.

SUMMARY OF THE INVENTION

Briefly stated, the present invention is a method for forming a seamless stainless steel sink bowl having a rim, a sidewall and a bottom surface interconnected by smooth corner surfaces from a single sheet. The sink bowl has a finished length, width and depth. The method comprises the steps of clamping a stainless steel blank having a thickness of at least approximately 1.2 mm to a surface of a first draw die. Drawing the blank between the first draw die and a first forming die to form a first drawn blank having an unfinished bowl with a length, width and depth which are less than the finished length and width. Generating a deformation warmth in the blank at the corner surfaces in proximity to the rim as the first drawn blank is being formed to a temperature of between approximately 70° C. and 90° C. Immediately removing the first drawn blank from the first draw die and the first forming die. Immediately clamping the first drawn blank to a surface of a finish draw die, and finish drawing the first drawn blank between the finish draw die and a finish forming die prior to loss of the deformation warmth to form a finish drawn blank having a finished bowl with the finished length, width and depth and simultaneously forming a ledge at a medial position in a portion of the sidewall of the finished bowl.

In another aspect, the present invention provides a seamless stainless steel sink bowl formed from a single sheet of material. The stainless steel sink bowl has a rim, a sidewall and a bottom interconnected by smooth corner surfaces. A ledge, generally parallel to the rim, is formed in a portion of the sidewall at a medial position.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 1:
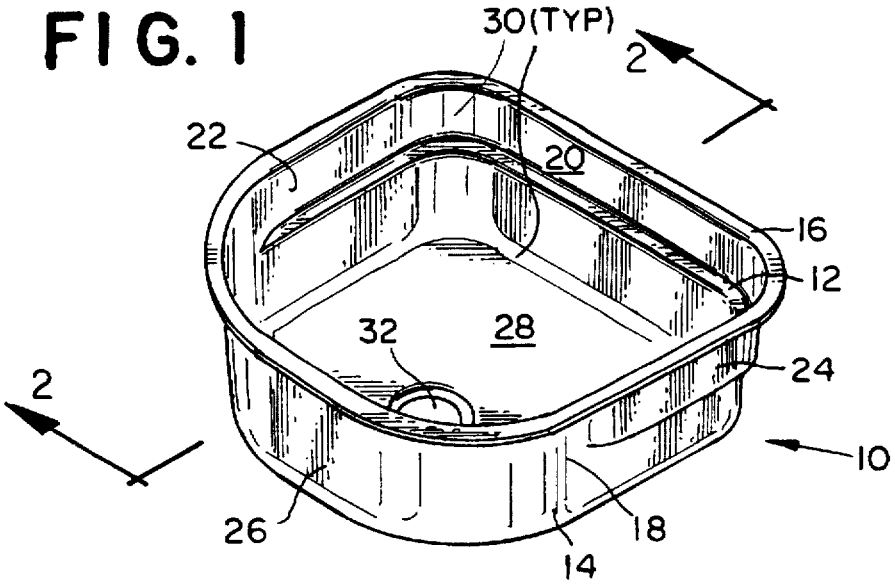
FIG. 1 is a perspective view of a sink bowl having a grid ledge in accordance with the present invention.

Certain terminology is used in the following description for convenience only and is not limiting. The words "right," "left," "lower" and "upper" designate directions in the drawings to which reference is made.

The words "inwardly" and "outwardly" refer to directions toward and away from, respectively, the geometric center of the stainless steel sink bowl or the press for forming the sink bowl and designated parts thereof. The terminology includes the words above specifically mentioned, derivatives thereof and words of similar import.

Figure 2:
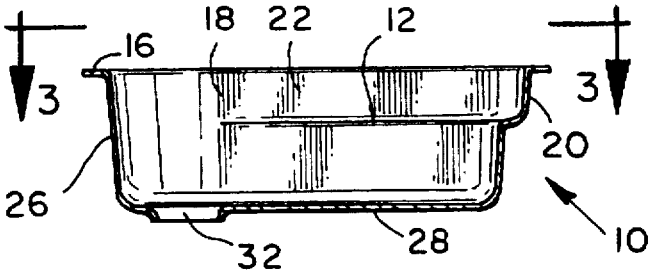
FIG. 2 is a section view taken along lines 2—2 in FIG. 1.
Figure 3:
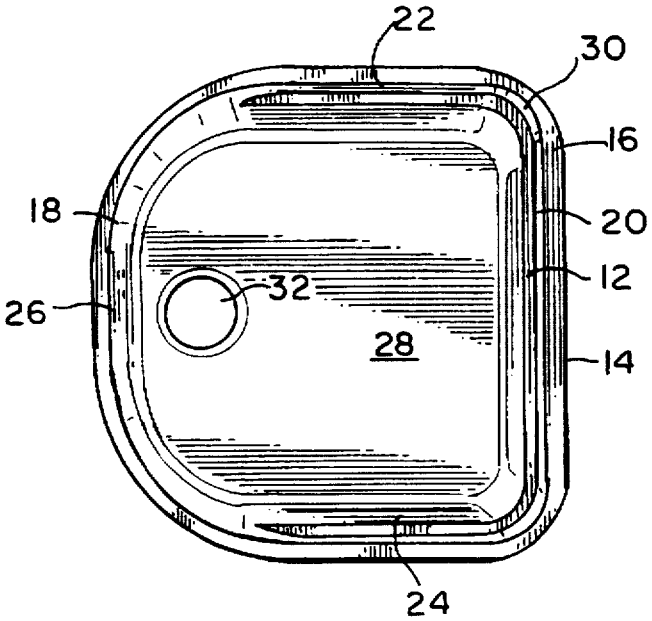
FIG. 3 is a top view taken along lines 3—3 in FIG. 2.

Referring to the drawings, wherein like numerals indicate like elements throughout, there is shown in FIGS. 1–3 a stainless steel sink bowl 10 formed from a single sheet of material having a grid ledge 12 in accordance with the present invention. The sink bowl 10 includes a bowl portion 14 having a rim 16 extending around the upper periphery, a sidewall 18, including first, second, third and fourth sides 20, 22, 24 and 26 and a bottom surface 28 which are interconnected by smooth corner surfaces generally designated 30. The grid ledge 12 is generally parallel to the rim 16 and is formed in a portion of the circumference of the sidewall 18 at a medial position. Preferably, the grid ledge 12 extends across the first side 20 and partially across the second and third sides 22 and 24 as shown in FIGS. 1–3. A drain opening 32 is located in the bottom 28.

In the preferred embodiment, the stainless steel sink bowl 10 is formed from 1.2 mm thick (18 gauge) stainless steel sheet. Preferably, 304 stainless steel sheet in the annealed condition is used. However, other austenitic stainless steel such as 316 stainless steel can also be used. In the preferred embodiment, the sink is approximately 230 mm (9.06 inches) deep and is approximately 540 mm (21.26 inches) in length and 480 mm (18.9 inches) in width. Preferably, the grid ledge 12 is located approximately 100 mm (3.94 inches) below the rim 16 and is approximately 11 mm (0.43 inches) wide. However, it will be recognized by those of ordinary skill in the art that larger or smaller sink bowls having various overall dimensions are within the scope of the present invention. However, the thickness of the material must be at least 1.2 mm (18 gauge) in order to form the sink bowl 10 with the grid ledge 12 in accordance with the present invention, as explained in more detail below.

A description of the method and apparatus for forming the deep drawn stainless steel sink bowl 10 with a grid ledge 12 follows with reference to FIGS. 4–11.

Figure 4:
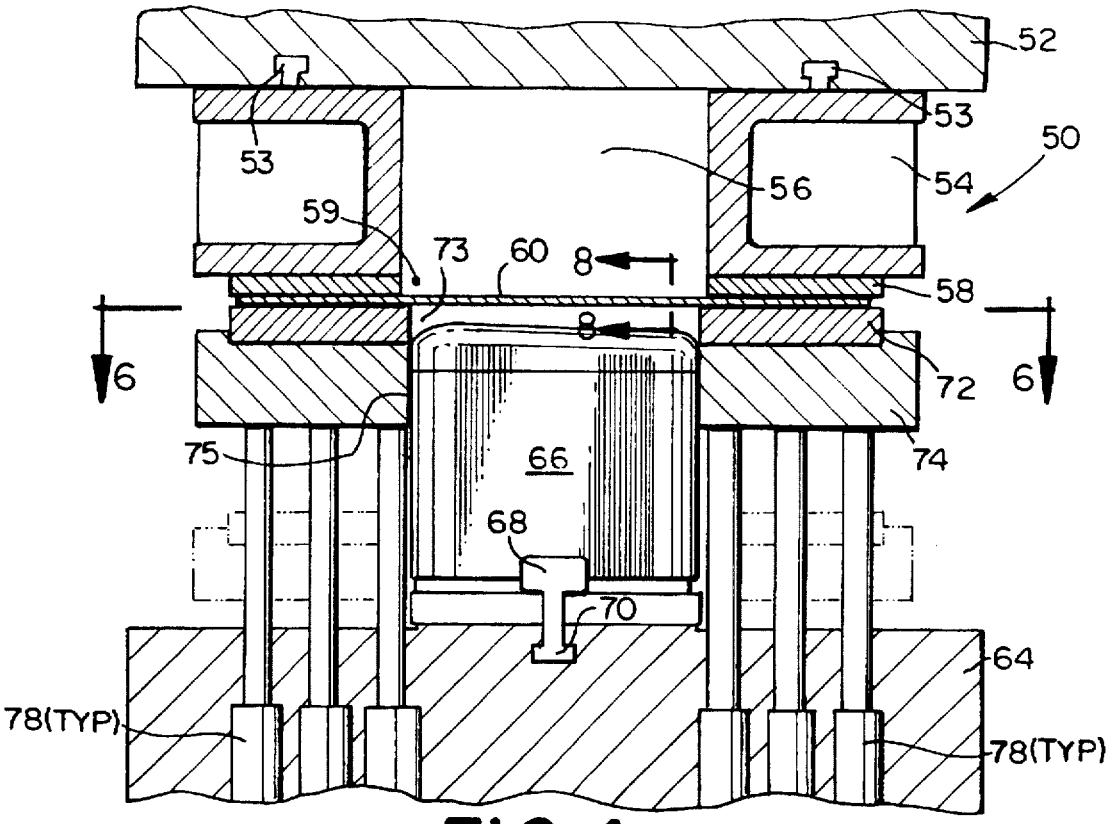
FIG. 4 is a side view, partially and cross section of a press configuration for, forming a first drawn blank in accordance with the present invention.
Figure 5:
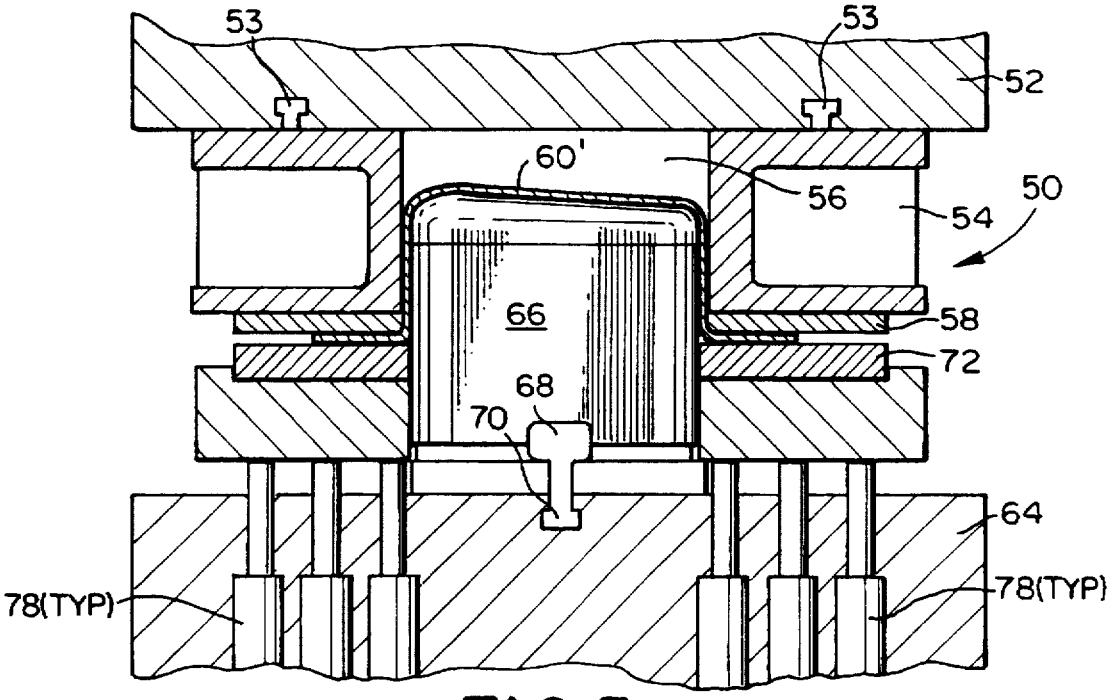
FIG. 5 is a side view, partially and cross section of the press configuration shown in FIG. 4 illustrating the formation of the first drawn blank.

Referring now to FIG. 4, a first draw press 50 is shown. The first draw press 50 is a double action press which includes a moveable die holder 52 to which the first draw die 54 is attached. The first draw die 54 is preferably attached by bolts (not shown) which are connected to T-nuts (not shown) located in the channels in the form of T-slots 53 on the moveable die holder 52. The first draw die 54 includes a draw face 58, which is located on the opposite side of the first draw die 54 from the moveable die holder 52 and openings 56, 59 are provided respectively through the first draw die 54 and the first draw face 58 through which the blank 60 is drawn. The moveable die holder 52 can be moved from a first position relative to a fixed support 64, as shown in FIG. 4, to a second position, as shown in FIG. 5.

The first draw press 50 also includes a fixed support 64 upon which the first forming die 66 is mounted. Preferably, the first forming die 66 includes an access opening 68 and the fixed support 64 includes T-slots 70, and the first forming die 66 is connected to the fixed support 64 with bolts (not shown) which are inserted through the access opening 68 and threadingly engaged in T-nuts (not shown) located in the T-slots 70.

A blank holder 72 mounted on a carrier 74 is positioned above the fixed support 64. The blank holder 72 and the blank holder carrier 74 include respective openings 73 and 75, and the first forming die 66 extends through the openings 73 and 75. The blank holder carrier 74 is movably supported by linear actuators 78 which extend through the fixed support 64. The linear actuators 78 can be used to move the blank holder carrier 74 and the blank holder 72, from a first position, shown in phantom lines in FIG. 4, to a second position shown in solid in FIG. 4.

Figure 6:
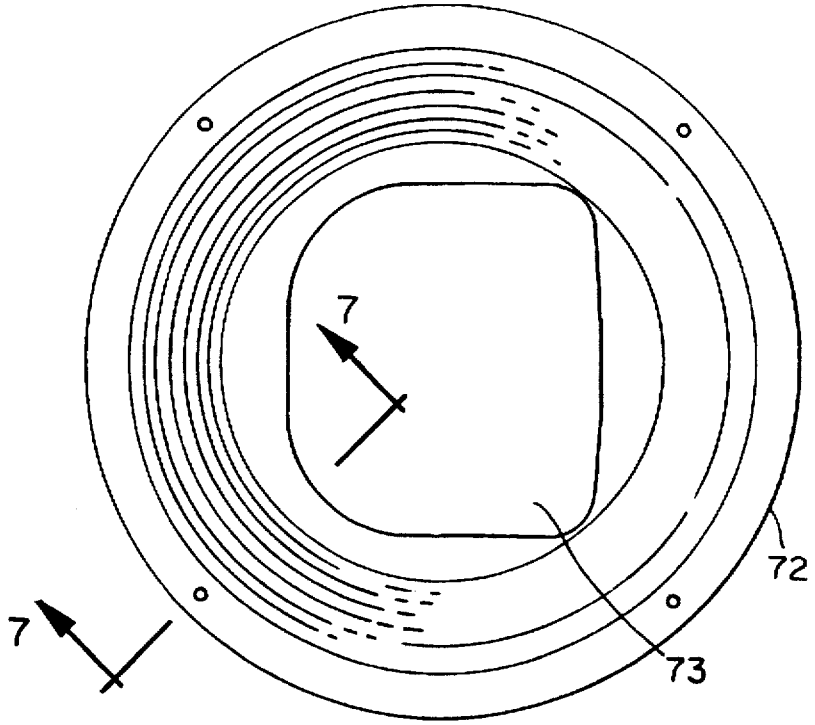
FIG. 6 is a view of a clamping plate taken along lines 6—6 in FIG. 4.
Figure 7:
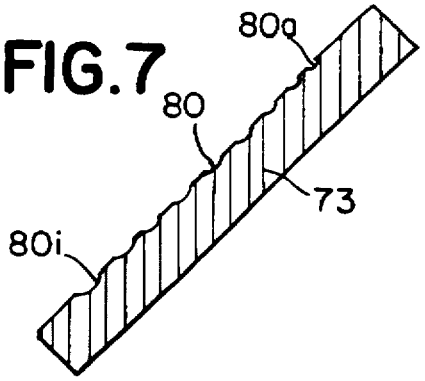
FIG. 7 is a section view taken along lines 7—7 in FIG. 6.

Referring now to FIGS. 6 and 7, the blank holder 72 is shown in detail. The surface of the blank holder 72 which contacts the blank 60 includes a plurality of annular grooves 80*a–i* concentrically spaced about the opening 73. The innermost groove 80*a* is smaller and shallower than the outermost groove 80*i*, and the intermediate grooves 80*b–g* are sized between the inner and outermost grooves 80*a*, 80*i*, with each succeeding groove having a slightly greater size and depth than the preceding groove.

The clamping surface of the first draw face 58 includes a plurality of annular grooves (not shown) similar to those of the blank holder 72. The first draw face 58 also includes a radius around the opening 59 in order to allow movement of the blank 60 as it is drawn without tearing or wrinkling. In the preferred embodiment, the opening 56 in the first draw die 54 is approximately 458 mm by 516 mm, and the radius around the edge of the opening 59 is approximately 20 mm. Preferably, the first draw face 58 and the blank holder 72 are made of TB 34.2 material (TB refers to deep drawing bronze, 34 indicates 340 kg/cm2, HB (Brinell Hardness), and 2 is the quality grade of the material). However, those skilled in the art will recognize that other suitable materials could be used. It will also be appreciated by those skilled in the art that the opening 59 in the draw face 58 is sized for the specific sink bowl 10 being made and the size and profile of the opening will be varied based on the specific shape of the sink bowl 10 desired. However, the opening 59 in the draw face 58 is preferably approximately 5 percent smaller than the dimensions of the desired finished sink bowl opening.

In the preferred embodiment, the first forming die 66 is approximately 486 mm long by 436 mm wide, which is approximately 20–30 mm smaller than the opening 59 in the draw face 58, and the first forming die 66 extends approximately 220 mm above the clamping surface of the blank holder 72 when the first forming die 66 is in the closed position as shown in FIG. 5. Preferably, the first forming die 66 is made from TB 34.2 material.

Figure 9:
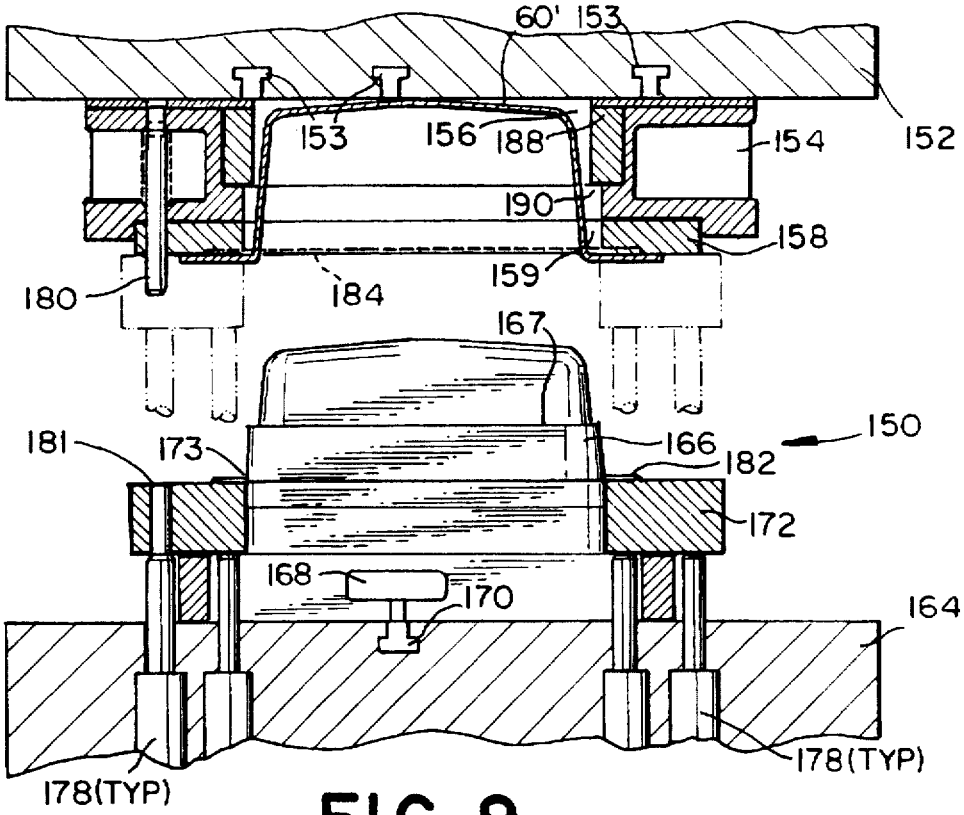
FIG. 9 is a side view, partially and cross section of a press configuration for forming a finished drawn blank in accordance with the present invention.
Figure 10:
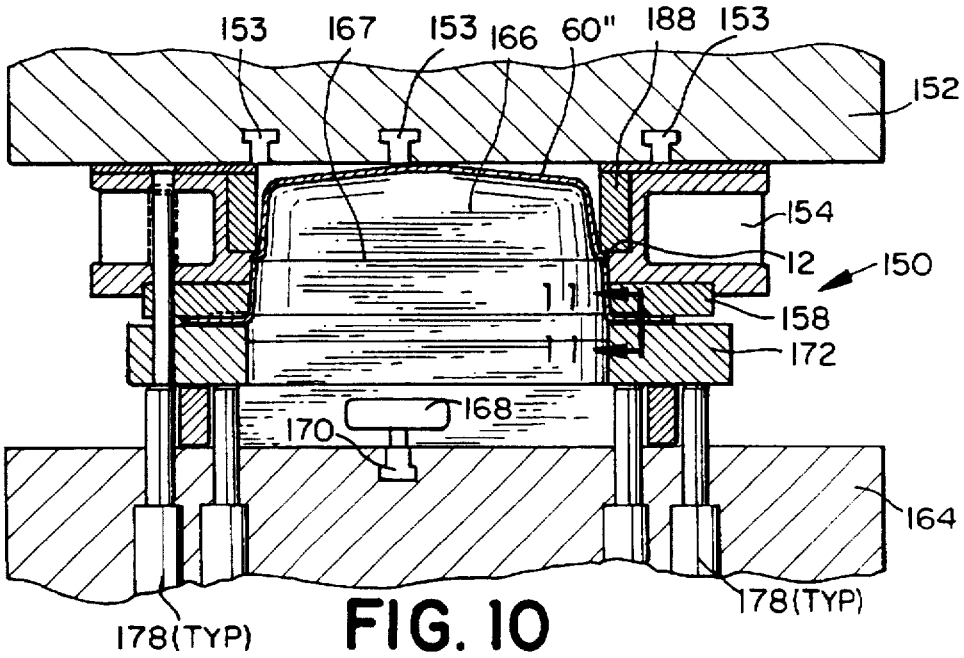
FIG. 10 is a side view, partially and cross section, similar to FIG. 9 showing the formation of the finished drawn blank in accordance with the present invention.

Referring now to FIGS. 9 and 10, the finish draw press 150 is shown. The finish draw press 150 is similar to the first draw press and like elements have been identified with like numerals including the prefix "1".

Figure 11:
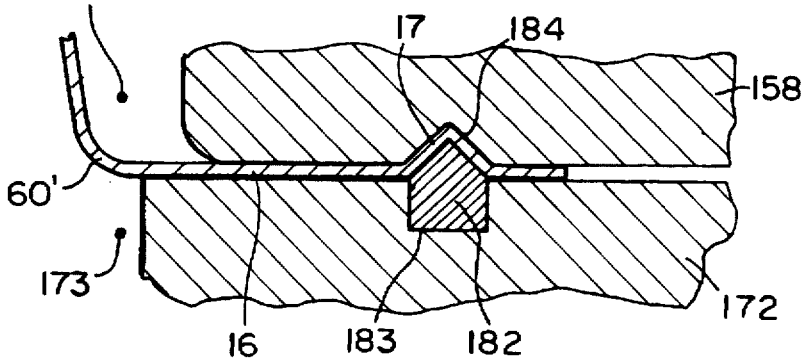
FIG. 11 is an enlarged section view taken along line 11—11 in FIG. 10.

As shown in FIGS. 9 and 10, the finish draw press 150 includes a moveable die holder 152 having T-slots 153 provided therein. A finish draw die 154 is attached to the moveable die holder 152 with bolts (not shown) inserted through apertures (not shown) in the finish draw die 154 and threadingly engaged with T-nuts (not shown) located in the T-slots 153. An opening 156 is provided through the finish draw die 154. The finish draw die 154 includes a stamping ring 188 located in the opening 156, which provides a shoulder 190 for the formation of the grid ledge 12 in the sink bowl 10. The finish draw die 154 further includes a finish draw face 158 located on the opposite side of the finish draw die 154 from the moveable die holder 152. The first drawn blank 60' is located in the finish draw die opening 156 and the opening 159 in the finish draw face 158. A guide pin 180 extends through the finish draw die 154 and the finish draw face 158. As shown in FIG. 11, a V-shaped groove 184 is located around the periphery of the opening 159 in the finish draw face 158.

The moveable die holder 152 can be moved from a first position relative to a fixed support 164, as shown in FIG. 9, to a second position, as shown in FIG. 10.

The finish draw press 150 also includes a fixed support 164 having at least one T-slot 170 provided thereon. A plurality of actuators 178 extend through the surface of the fixed support 164. A finish forming die 166 is attached to the fixed support 164. Preferably, the finish forming die 166 has an opening 168 provided therein and one or more bolts (not shown) are inserted through the opening and are threadingly engaged in T-nuts (not shown) located in the T-slot 170. The finish forming die 166 includes a step 167 which is complementary to the shoulder 190 on the stamping ring 188 located in the finish draw die 154. Preferably, the step 167 extends along a first side and portion of the second and third sides of the finish draw die which correspond to the location of the ledge 12 along the first side 20 and the portions of the second and third sides 22 and 24 of the sink bowl 10, as shown in FIG. 1. Preferably, the finish forming die is made of TB 34.2 material.

A finish blank holder 172 is located around the finish forming die 166, and the finish forming die 166 extends through an opening 173 in the finish blank holder 172. The finish blank holder 172 is movably supported by linear actuators 178 which extend through the fixed support 164. The linear actuators 178 can be used to move the finish blank holder 172 from a first position, as shown in FIG. 9, to a second position, as shown in phantom lines in FIG. 9, to clamp the first drawn blank 60' in position.

As shown in FIG. 11, a raised, lip forming die 182 is located in a groove 183 located around the periphery of the opening 173 in the finish blank holder 172. The lip forming die 182 is complementary to the V-groove 184 in the finish draw face 158.

The method for forming a seamless stainless steel sink bowl having a rim 16, a sidewall 18 and a bottom surface 28 interconnected by smooth corner surfaces 30 from a single sheet will now be explained in detail with reference to FIGS. 4–11. For convenience, portions of the first drawn and finish drawn blanks 60' and 60" are described and referred to by the reference numerals associated with the finished sink bowl 10 in order to provide a clear explanation of the forming process.

Figure 8:
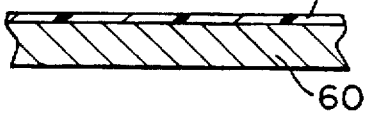
FIG. 8 is a section view taken along lines 8—8 in FIG. 4.

Referring to FIG. 4, a flat stainless steel blank 60 which is preferably made from 1.2 mm (18 gauge) 304 stainless steel is provided. As shown in FIG. 8, a lubricating film or foil 61 is attached to a first side of the blank 60 which is in facing engagement with the first draw face 58. Preferably, the lubricating film is a PoliChemie PFV 32C plastic film available from Polichemie-Foilen AG, Kilchberg, Switzerland, and is attached with acrylic glue.

Referring again to FIG. 4, the first forming die 66 is lubricated with a lubricant such as Blasol CF 2000, thinned as a 20 percent emulsion, which is available from Blaser AG, Hasleruegsau. The stainless steel blank 60 is positioned on the blank holder 72, and the actuators 78 are raised as shown in FIG. 4 such that the blank holder 72 presses against the blank 60 and the draw face 58 to clamp the stainless steel blank 60 in position. Preferably, the clamping pressure is a constant 4800 kN.

As shown in FIG. 5, once the blank 60 has been clamped in position, the movable die holder 52 of the first draw press 50 is moved toward the fixed support 64 such that blank contacts the first forming die 66 drawing the blank 60 between the first draw die 54, with draw face 58, and the first forming die 66 to form a first drawn blank 60' having a unfinished bowl with a length, width and depth which are less than the finished length, width and depth desired. In the preferred embodiment, the first draw is carried out at about 15,000 kN. Preferably, the length and width of the bowl formed in the first drawn blank 60' are approximately 5 percent less than the finish length and width desired. In order to form the grid ledge 12 around at least a portion of the sidewall 18 of the bowl 14 in the subsequent finish draw, the depth of the first draw is approximately equal to or slightly less than the desired finish draw depth. In the preferred embodiment, the first draw depth is approximately 10 mm less than the finish draw depth.

As the blank 60 is drawn to form the first drawn blank 60', a deformation warmth is generated in the blank 60 at the smooth corner surfaces 30 in proximity to the rim 16. The deformation warmth raises the temperature of the first drawn blank 60' at the corner surfaces 30 in proximity to the rim 16 to a temperature of about approximately 70° C. to 90° C., and preferably to 80° C.

The first drawn blank 60' is then immediately removed from the first draw die 54 and the first forming die 66, and transferred to the finish draw die 154 in the finish draw press 150, as shown in FIGS. 9 and 10. Due to the deformation warmth, the first drawn blank 60' can be transferred by hand with heavy duty gloves or can be moved by a machine, such as a robotic arm (not shown).

As the blank 60 is being drawn, the material around the periphery of the draw face opening 59 is drawn through the opening 59 and into the first draw die 54 by the first forming die 66. The clamping pressure must be maintained at approximately 4800 kN by the actuators 78 so that the material of the blank 60 is drawn smoothly to form smooth surfaces instead of wrinkling as it is drawn. The grooves **80*a*–80*i* in the clamping surfaces of the blank holder 72 and the first draw face 58** draw off excessive lubricant.

Referring now the FIG. 9, the first drawn blank 60' is clamped to the finish draw face 158 of the finish draw die 154, with the bowl extending through the finish draw die and draw face openings 156 and 159. The actuators 178 are raised to clamp the first drawn blank 60' between the finish draw face 158 and the finish blank holder 172. The guide pin 180 located in the finish draw die 154 is aligned with the corresponding opening 181 in the finish blank holder 172. As the first drawn blank 60' is clamped in position, the lip forming die 182 in the finish blank holder 172 forms a lip 17 around the periphery of the rim 16 of the bowl 14 in a first drawn blank 60'. This also prevents additional material from being drawn from around the periphery of the first drawn blank 60' as the first drawn blank 60' is finish drawn.

The first drawn blank 60' is finish drawn between the finish draw die 154, with the finish draw face 158, and the finish forming die 166. The movable die holder 152 is moved toward the fixed support 164 such that the finish forming die 166 with the step 167 draws the first drawn blank 60', as shown in FIG. 9, to form the finish drawn blank 60", as shown in FIG. 10. The finish draw is carried out prior to loss of the deformation warmth in the first drawn blank 60', which significantly improves the property of the blank material for further drawing, to form a finish drawn blank 60" having a finished bowl with the finished length, width and depth and to simultaneously form the grid ledge 12 at a medial position in at least a portion of the sidewall 18 of the finished bowl 14. A portion of the sidewall 18 in the first drawn blank 60' is moved tangentially to form the grid ledge 12 as the first drawn blank 60' is being drawn without forming puckers in the sidewall 18. Preferably, the finish drawing operating is carried out at approximately 10,000 kN.

The forming operation during finish drawing is considerably more difficult than with standard sink bowls because the finish forming die 166 does not close completely with the finish draw die 154. Instead, the bottom 28 of the bowl is formed on the finish forming die 166, and the finish draw die 154 stops when the shoulder 190 contacts the step 167 to form the ledge 12. Accordingly, the finish draw die 154 does not close completely with the finish forming die 166 and the finish drawn blank 60" is not "stamped" between matching dies. Additionally, the ledge 12 is formed at a medial position on the first side 20 and portions of the second and third sides 22 and 24, and is not a uniform step around the entire sidewall 18 of the sink bowl.

The finish drawn blank 60' is removed from the finish draw and forming dies 154, 166 and the excess portion of the blank around the lip 17 is trimmed. In order to finish the sink bowl 10 with the grid ledge 12, a drain opening 32 is stamped in the bottom surface 28 for a drain outlet. Other finishing operations can then be performed, such as polishing or burnishing the sink bowl 10, if desired.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A seamless stainless steel sink bowl having a rim, a sidewall and a bottom surface interconnected by smooth corner surfaces from a single sheet, the sink bowl having a finished length, width and depth, formed by the method of:

clamping a stainless steel blank having a thickness of at least approximately 1.2 mm to a surface of a first draw die;

drawing the blank between the first draw die and a first forming die to form a first drawn blank having an unfinished bowl with a length, width and depth which are less than the finished length, width and depth;

generating a deformation warmth in the blank at the corner surfaces in proximity to the rim as the first drawn blank is being formed to a temperature of between approximately 70° C. and 90° C.;

immediately removing the first drawn blank from the first draw die and the first forming die;

immediately clamping the first drawn blank to a surface of a finish draw die; and finish drawing the first drawn blank, prior to loss of the deformation warmth, between the finish draw die and a finish forming die to form a finish drawn blank having a finished bowl with the finished length, width and depth, the finish drawing including tangentially expanding a non-continuous portion of the sidewall of the first drawn blank and forming the tangentially expanded non-continuous portion between a step in the finish draw die and a complementary shoulder in the finish forming die to form a non-continuous ledge at a medial position in the portion of the sidewall of the finished bowl.

2. A stainless steel sink bowl having a top edge, a sidewall and a bottom surface interconnected by smooth corner surfaces from a single sheet, the sink bowl having a finished length, width and depth, the sink bowl being formed by the steps of:

providing a stainless steel blank with a plastic lubricating film attached to one side;

clamping the blank to a surface of a first draw die with a clamping die having a clamping surface with a plurality of grooves;

drawing the blank between the first draw die and a first forming die to form a first drawn blank having an unfinished bowl with a length and a width which are less than the finish length and width;

generating a deformation warmth in the blank at the corner surfaces in proximity to the top edge as the first drawn blank is being formed to a temperature of between approximately 70° C. and 90° C.;

immediately removing the first drawn blank from the first draw die and the first forming die;

clamping the first drawn blank to a surface of a finish draw die; and finish drawing the first drawn blank, prior to loss of the deformation warmth, between the finish draw die and a finish forming die to form a finish drawn blank, the finish draw die including a non-continuous step and the finish forming die including a complementary non-continuous shoulder, the finish drawn blank having a finished bowl with the finished length, width and depth, the finish drawing including tangentially expanding a non-continuous sidewall portion of the first drawn blank and simultaneously forming a non-continuous ledge, between the step in the finish draw die and the finish forming die, at a medial position in the sidewall portion of the finish drawn bowl.

* * * * *